US010080406B2

(12) United States Patent
Montaquila

(10) Patent No.: US 10,080,406 B2
(45) Date of Patent: Sep. 25, 2018

(54) ADJUSTABLE BRACELET

(71) Applicant: Aro-Sac, Inc., North Providence, RI (US)

(72) Inventor: Robert A. Montaquila, North Providence, RI (US)

(73) Assignee: Aro-Sac, Inc., North Providence, RI (US)

( * ) Notice: Subject to any disclaimer, the term of this patent is extended or adjusted under 35 U.S.C. 154(b) by 295 days.

(21) Appl. No.: 15/042,764

(22) Filed: Feb. 12, 2016

(65) Prior Publication Data

US 2017/0231335 A1 Aug. 17, 2017

(51) Int. Cl.

| | |
|---|---|
| ***A44C 5/00*** | (2006.01) |
| ***A44C 5/20*** | (2006.01) |
| ***A44C 15/00*** | (2006.01) |

(52) U.S. Cl.

CPC ..... *A44C 5/2019* (2013.01); *A44C 15/0085* (2013.01)

(58) Field of Classification Search

CPC ... A44C 5/0084; A44C 5/0092; A44C 5/2019; A44C 5/22; Y10T 24/1318

USPC ..... 63/3.1, 3.2

See application file for complete search history.

(56) References Cited

U.S. PATENT DOCUMENTS

| | | | |
|---|---|---|---|
| 14,438 | A | 11/1883 | Ahn |
| 421,615 | A | 2/1890 | Riker |
| 993,303 | A | 5/1911 | Kirby |
| 1,709,181 | A | 4/1929 | Matlock |
| 2,555,196 | A | 5/1951 | Kostka |
| 2,954,621 | A | 10/1960 | Mosher, Jr. et al. |
| 4,033,143 | A | 7/1977 | Michael |
| D267,159 | S | 12/1982 | Borofsky |
| 5,036,423 | A | 7/1991 | Williams |
| 5,131,243 | A | 7/1992 | Coleman |
| D372,680 | S | 8/1996 | Salva et al. |
| 5,603,231 | A | 2/1997 | Abraham |
| 5,605,059 | A | 2/1997 | Woodward |
| 5,657,645 | A | 8/1997 | Abraham |
| 6,085,550 | A | 7/2000 | Ishida |
| D451,372 | S | 12/2001 | Cedarberg, III |
| 6,470,708 | B1 | 10/2002 | Green |
| D474,423 | S | 5/2003 | James |
| 6,675,612 | B2 | 1/2004 | Nanasi |
| 6,799,436 | B1 | 10/2004 | Minassian |
| D498,167 | S | 11/2004 | Ferlise |
| 7,210,313 | B1 | 5/2007 | Kay |
| D597,881 | S | 8/2009 | Hou |
| D616,325 | S | 5/2010 | Shaforost |
| D618,128 | S | 6/2010 | Clark et al. |
| 7,788,947 | B2 | 9/2010 | Loetscher et al. |
| D704,087 | S | 5/2014 | DiPietro |
| D759,528 | S | 6/2016 | Stepper et al. |

(Continued)

*Primary Examiner* — Jack W Lavinder

(74) *Attorney, Agent, or Firm* — Nixon Peabody LLP

(57) ABSTRACT

A bracelet having an adjustable clasp portion. The bracelet includes a clasp portion defining a first end, a hook portion having a hook defining a second end, and a band portion between the clasp portion and the hook portion. The clasp portion has raised structures separated by openings and is curved to follow a curvature of the band portion. Each of the raised structures extends laterally relative to the band portion and protrudes beyond an outer surface of the band portion to be engaged by the hook.

18 Claims, 21 Drawing Sheets

(56) References Cited

U.S. PATENT DOCUMENTS

| | | | | |
|---|---|---|---|---|
| 2012/0159987 | A1 | 6/2012 | Walchle et al. | |
| 2015/0075218 | A1* | 3/2015 | Stepper ..... | A44C 5/12<br>63/3.2 |

* cited by examiner

ADJUSTABLE BRACELET

FIELD OF THE INVENTION

The present disclosure relates to bracelets, and more particularly, to bracelets featuring an adjustable clasp.

BACKGROUND

Bracelets can be worn around a wrist or an ankle. But wrist and ankle sizes vary widely, among adults and children alike, so there is no one-size-fits-all bracelet. Adjustable bracelets allow the circumference of the bracelet to be adjusted to accommodate different wrist or ankle sizes. Existing adjustable bracelets that feature a clasp suffer from several problems. For example, the clasp can become disconnected while the bracelet is worn, such as when the wearer bangs into something, or when the clasp becomes hooked onto something. In worst cases, the bracelet can fall off the wearer, sometime without the wearer's immediate realization, or the clasp feature can become damaged or bent, sometimes irreversibly. Clasp closure can also be problematic, particularly when it can take several attempts by the wearer using a free hand to close the clasp.

What is needed is an adjustable bracelet that overcomes these and other problems.

BRIEF SUMMARY

According to an aspect of the present disclosure, what is disclosed is a bracelet having an adjustable clasp portion. The bracelet includes a clasp portion defining a first end, a hook portion having a hook defining a second end, and a band portion between the clasp portion and the hook portion. The clasp portion includes raised structures separated by openings and is curved to follow a curvature of the band portion. Each of the raised structures extends laterally relative to the band portion and protrudes beyond an outer surface of the band portion to be engaged by the hook. The clasp portion can further include a pair of parallel support members. Each of the raised structures can span the parallel support members to define the respective openings. Each of the openings can be dimensioned to allow the hook portion to pass through each of the openings. Each of the raised structures can be curved to form an inner concave surface and an outer convex surface. The clasp portion can overlap part of the band portion as the hook portion engages a distal one of the raised structures such that the overlap between the clasp portion and the band portion results in a smaller gap compared to a bracelet in which the clasp portion is straight.

The bracelet can further include a cover having a curved profile that follows the curvature of the clasp portion. The cover can be configured to cover the clasp portion and can have a gap between the clasp portion sufficient to allow the hook portion to be disengaged from any of the raised structures. The cover can include angled features that snap over the clasp portion to secure the cover to the clasp portion.

The bracelet can further include magnets positioned to magnetically fix the cover and the clasp portion together. The cover can include recessed features to permit the cover to be slid over the clasp portion to thereby secure the cover to the clasp portion when the hook portion is unhooked from the clasp portion. The bracelet can further include a removable insert that forms a top surface portion of the cover.

The removable insert can be snapped, clicked, press-fit, or snap-fit into recessed features formed in the cover. The cover can include a hole to permit an object passed through the hole to disengage the insert from the cover. The removable insert can be curved to follow a curvature of the cover. The curvature of the removable insert can parallel that of the clasp portion when the removable insert is inserted into the cover and the cover is installed over the clasp portion.

The cover and/or the removable insert can be composed of a metal. The cover and/or the removable insert can include on a top surface thereof any one or more of a filigree, alphanumeric characters, a raised design, or a carving.

The cover can be configured to completely cover the clasp portion so that the clasp portion together with the hook portion are not visible from a top of the cover when the cover is secured onto the clasp portion.

Figure 1:
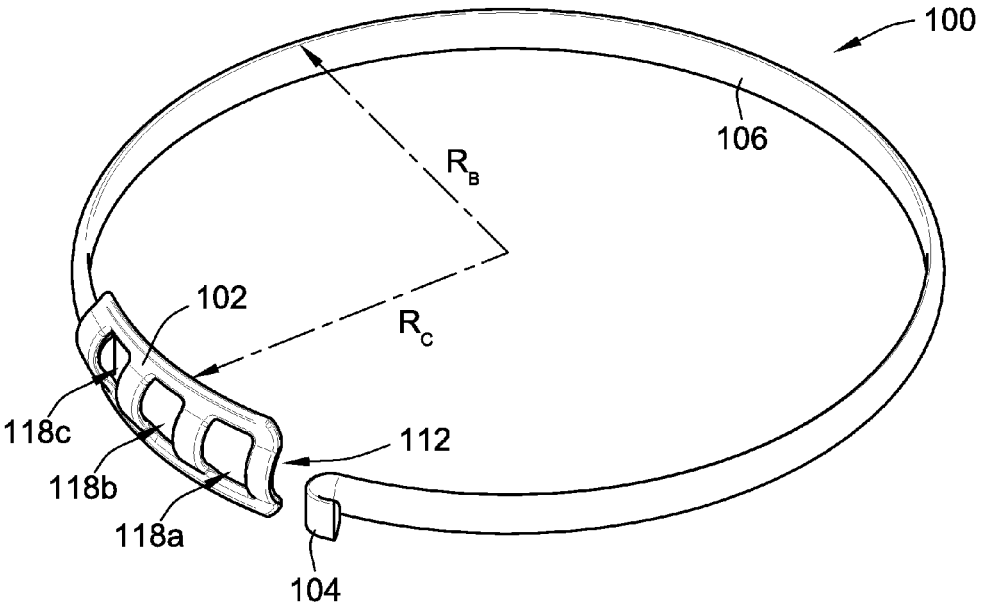
FIG. 1 is an isometric view of an adjustable bracelet featuring a clasp portion, a hook portion, and a band portion.
Figure 56:
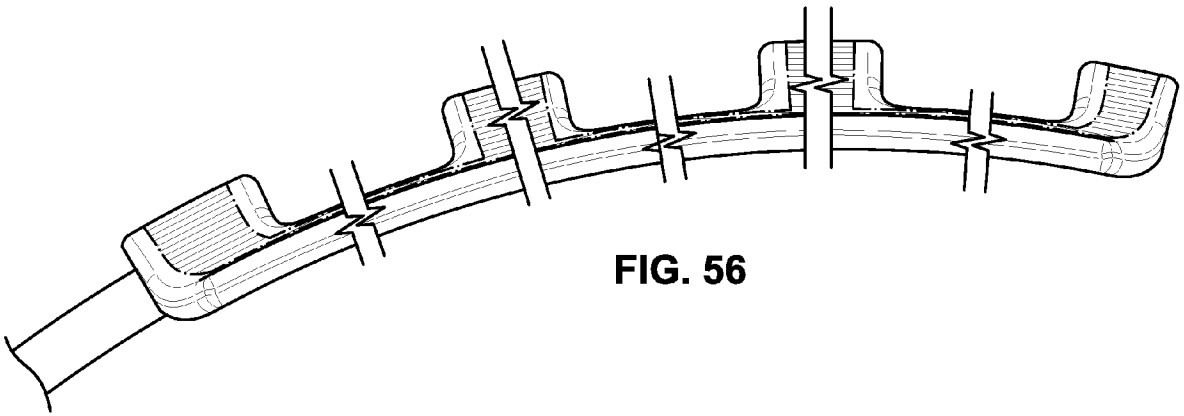
FIG. 56 is a side view of the adjustable clasp shown in FIG. 17.
Figure 54:
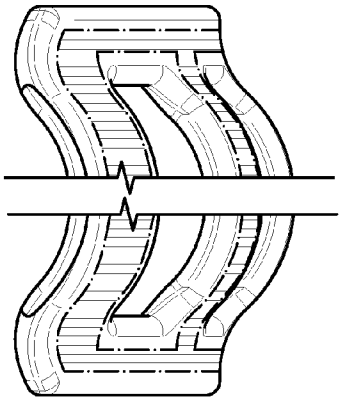
FIG. 54 is an end view of the adjustable clasp shown in FIG. 17.

The broken lines shown in FIGS. 1-56 are only for illustrative purposes to show visible environmental structure and form no part of any ornamental design claimed herein.

DETAILED DESCRIPTION

While this disclosure is susceptible of embodiment in many different forms, there is shown in the drawings and will herein be described in detail various aspects with the understanding that the present disclosure is to be considered as an exemplification of the principles of the inventions herein and is not intended to limit the broad aspect of the inventions to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

FIG. 1 is an isometric view of an adjustable bracelet 100 featuring a clasp portion 102, a hook portion 104, and a band portion 106. By adjustable, it is meant that a circumference of the bracelet 100 can be increased or decreased. The bracelet 100 can be made from one or more materials that include metal or plastic or stone or glass, to name a few examples. The band portion 106 can be made out of a round wire, such as a ½ round, or a square wire, etc.

Figure 2A:
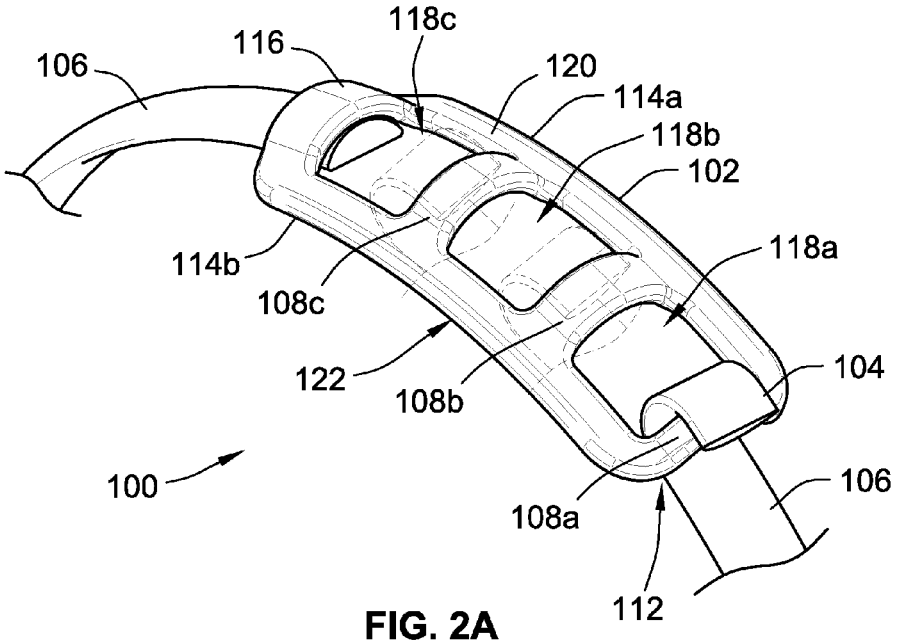
FIG. 2A is an isometric view of part of the bracelet shown in FIG. 1 showing the hook portion engaging the clasp portion.

FIG. 2A is an isometric view of part of the bracelet 100 shown in FIG. 1 showing the hook portion 104 engaging a raised structure 108*a* of the clasp portion 102. The clasp portion 102 in this example has two other raised structures 108*b*, 108*c*, which can also receive the hook portion 104 and engage it to the clasp portion 104. The raised structures 108*a,b,c* are supported by a pair of support members 114*a,b* and a support member 116 that is coupled to the band portion 106. The hook portion 104 is shown in broken lines to show the two other positions when engaged to the raised structures 108*b*, 108*c*. The clasp portion 104 is curved to follow a curvature of the band portion 106. For example, in FIG. 1, the radius $R_B$, which represents a radius of the band portion 106 is substantially equal to the radius $R_C$, which represents a radius of the clasp portion 102. Thus, by following a curvature, it is meant that the clasp portion 104 is curved so that if it were eliminated and replaced by the band portion 106, the curvature of the band portion 106 would continue in the area where the clasp portion 104 occupied following the same curvature (or radial arc) as the rest of the band portion 106. While the bracelet 100 is shown having a generally circular shape, the bracelet 100 can also be a slightly oval or ovular or ovoid shape. The clasp portion 104 wherever situated on an oval or ovoid-shaped bracelet would be curved to follow whatever curvature the oval or ovoid would take in the area occupied by the clasp portion 104. Benefits of having the clasp portion 102 follow a curvature of the band portion 106 can be seen in FIG. 2B.

Figure 2B:
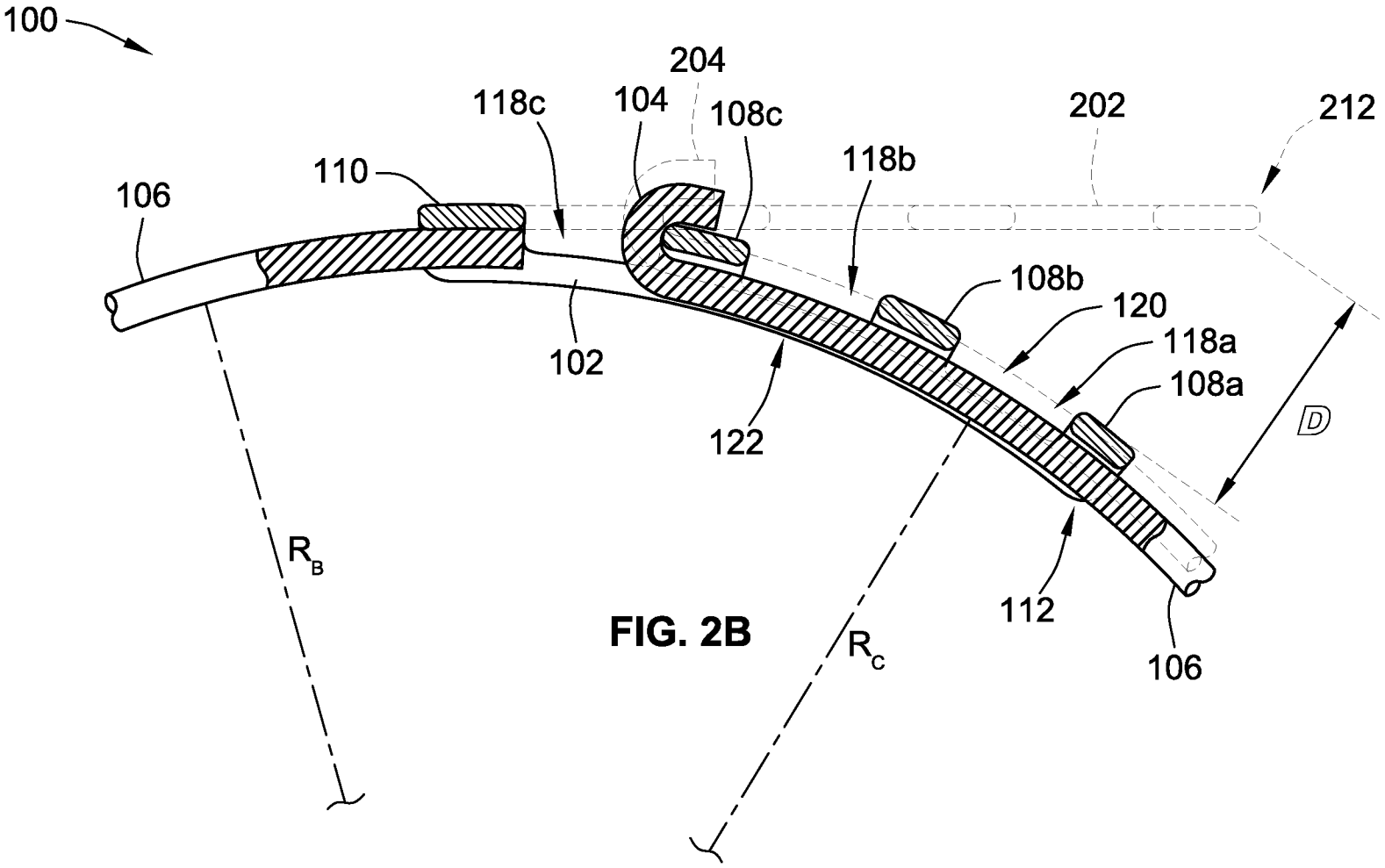
FIG. 2B is a cross sectional view of the part shown in FIG. 2A to show the curvature of the clasp portion following the curvature of the band portion as compared to a conventional clasp design that produces a significant gap between the end of the clasp portion and the band portion.

FIG. 2B is a cross sectional view of the part shown in FIG. 2A to show the curvature of the clasp portion 102 following the curvature of the band portion 106 as compared to a conventional clasp design that produces a significant gap, D, between the end of the conventional clasp 202 portion and the band portion 106. Here, the hook portion 104 is shown engaged with the raised structure 108*c*, placing the adjustable bracelet 100 in the smallest or tightest configuration. As the circumference or diameter of a conventional adjustable bracelet is reduced, the size of the gap formed between a free end 212 of the conventional clasp portion 202 increases, as can be seen by a conventionally straight clasp 202 shown in broken lines in FIG. 2B. Such a gap, D, creates opportunities for this free end 212 to catch on other objects, deforming the clasp or unhooking the clasp 202 from the hook 204 while the bracelet is being worn.

While there may be a small gap formed between the free end 112 of the clasp portion 102 and the part of the band portion 106 with which the clasp portion 102 overlaps, owing to manufacturing variations and other practical real-world considerations, this gap will be significantly smaller than the distance, D, shown in FIG. 2B. Those skilled in the art will appreciate that forming a theoretically perfectly curved clasp portion 102 that perfectly follows the band portion 106 is very difficult due to the vagaries of working with certain materials, such as metal, but the objective here is to close that gap as much as possible to allow the clasp portion 102 to follow the curvature of the band portion 106 as closely as possible.

Figure 3:
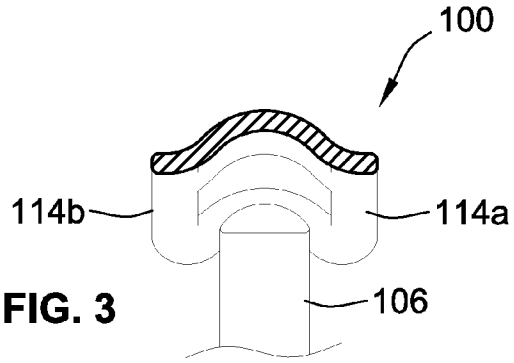
FIG. 3 is an end view of the clasp portion shown in FIG. 2A in which one of the raised structures can be seen on the clasp portion.
Figure 4:
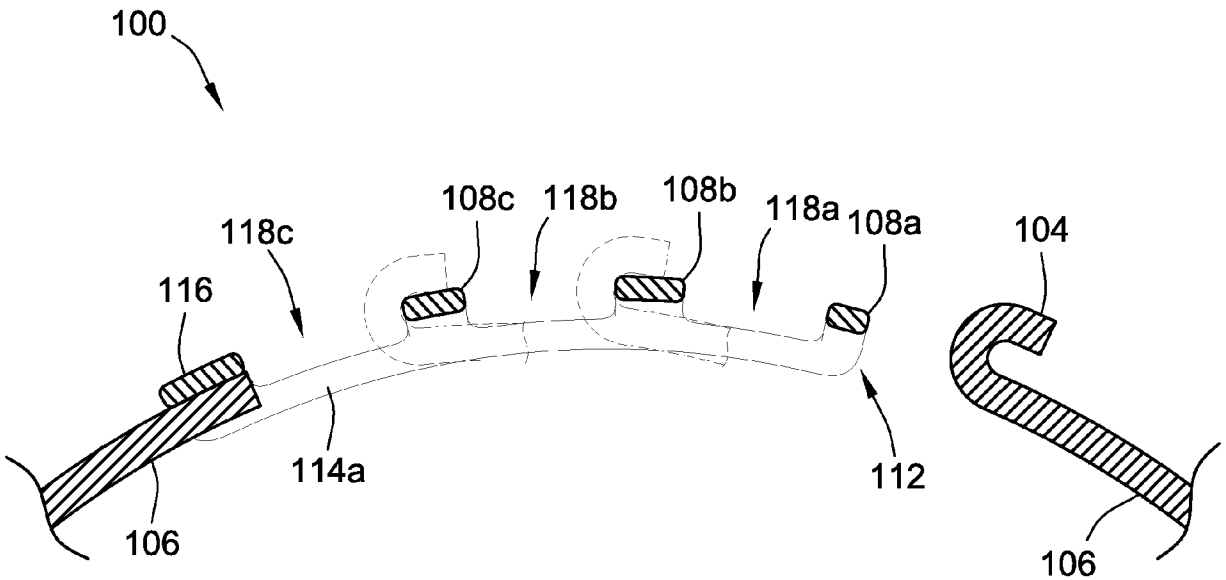
FIG. 4 is a cross sectional view of the adjustable bracelet of FIG. 1 showing how the hook portion can engage different ones of the raised structures on the clasp portion.

To further aid in maintaining the generally curved shape of the clasp portion 102, the clasp portion 102 has a concave inner surface 122 and a convex outer surface 120 (seen in FIGS. 2A and 2B). The inner surface 122 of the clasp portion 122 is the surface that faces toward a center of the bracelet 100, whereas the outer surface 120 of the clasp portion 122 is the surface that faces away from the inner surface 122. Moreover, each of the raised structures 108*a,b,c* is similarly curved to form an inner concave surface and an outer convex surface along a transverse direction relative to the pair of support members 114*a*, 114*b* of the clasp portion 102 (see FIG. 3). Each of the raised structures 108*a,b,c* span the support members 114*a,b* to define openings 118*a,b,c* in the clasp portion 102. The raised structures 108*a,b,c* can resemble ribs or spanning members. These raised structures 108*a,b,c* extend in a lateral direction relative to the band portion 106 and protrude beyond an outer surface of the band portion 106, such as can be seen in FIG. 3. When the hook portion 104 is formed by making a bend in the band portion 106, such as when the band portion 106 is composed of a metal wire, the curved shape of the raised structures 108*a,b,c* and their protrusion above the surface of the band portion 106 contribute to an easy and reliable engagement of the hook portion 104 and the intended raised structure 108*a,b,c* that the wearer desires to hook so that the bracelet 100 fits comfortably on the body part around which the bracelet 100 is worn.

The hook portion 104 is generally held under tensile force against one of the raised structures 108*a,b,c*. When the band portion 106 is composed of a metal and formed into a generally circular or oval or ovoid shape, the band portion 106 will prefer to maintain a steady state circumference, which can represent the loosest or widest configuration of the adjustable bracelet 100. When the band portion 106 is closed to form a tighter configuration, the band portion 106 will have a tendency to exert a tensile force in a direction of a wider configuration, which allows the hook portion 104 to remain reliably engaged with whichever raised structure 108*a,b,c* the wearer has selected for engagement. To release the clasp portion 102 from the hook portion 104, the wearer gently compresses the band portion 106 into a tighter configuration and then urges the hook portion 104 out of one of the openings 118*a,b,c* to free it from the clasp portion 102.

Figure 5:
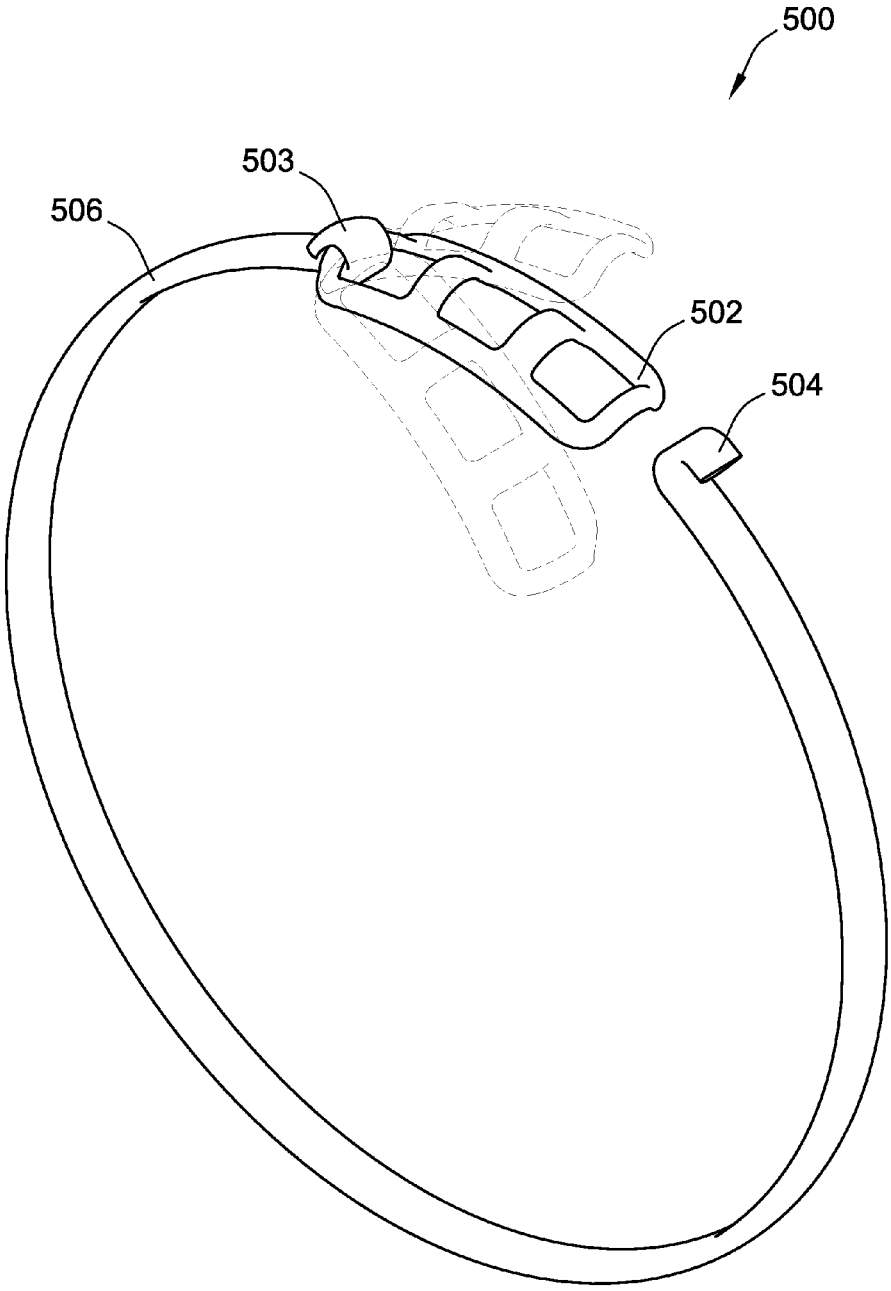
FIG. 5 is an isometric view of another implementation of an adjustable bracelet featuring a hinge that allows the non-free end of the clasp portion to rotate.
Figure 6:
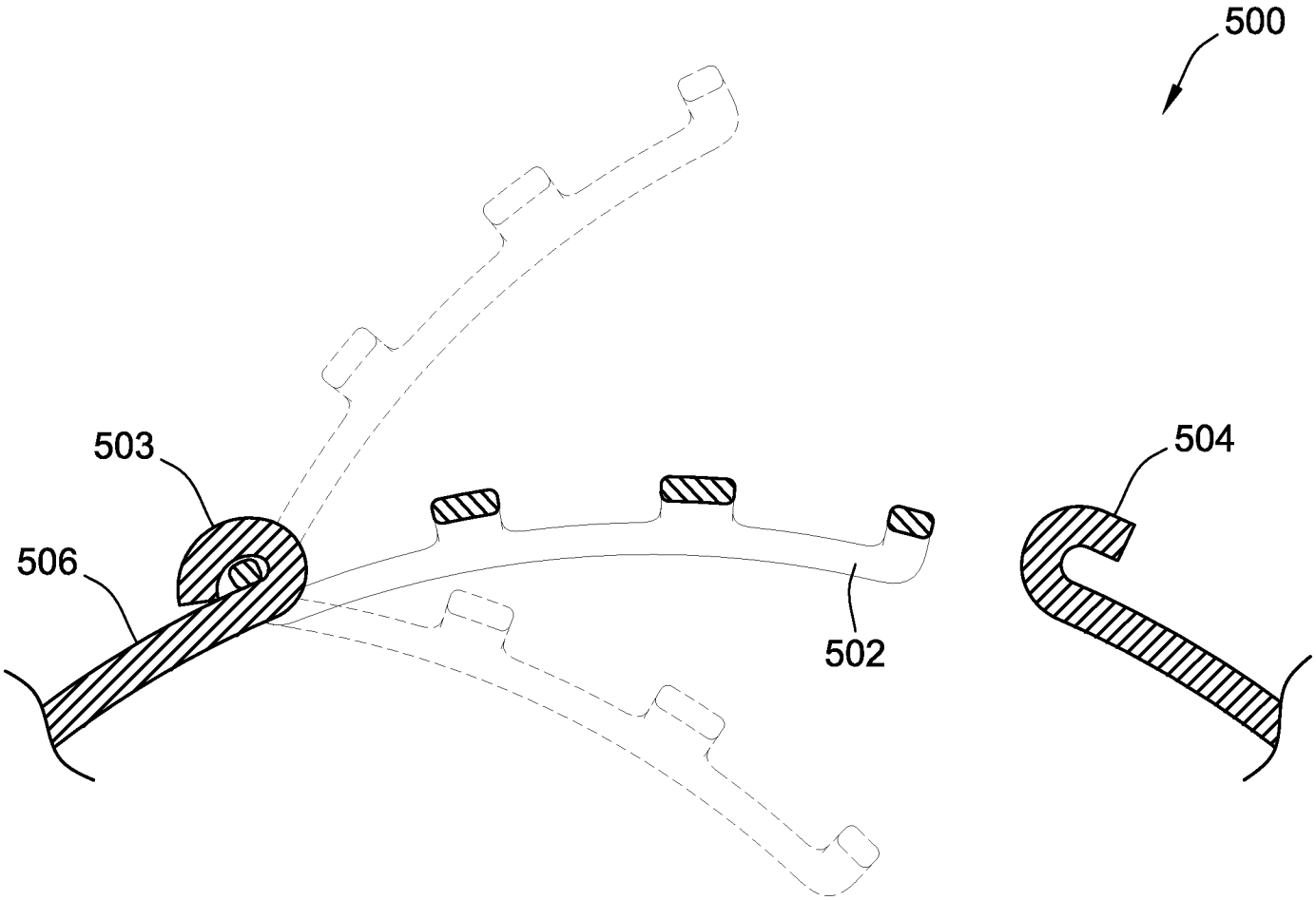
FIG. 6 is a cross sectional view of the adjustable bracelet shown in FIG. 5 in three different (exaggerated) hinged positions.

FIG. 5 is an isometric view of another implementation of an adjustable bracelet 500 featuring a hinge 503 that allows the non-free end of a clasp portion 502 to rotate. The hinge 503 allows the clasp portion 502 more freedom to conform at both ends of the band portion 506 to the wearer's body part around which the bracelet 500 is worn. FIG. 6 is a cross sectional view of the adjustable bracelet shown in FIG. 5 in three different (exaggerated) hinged positions. Whatever small gap between the clasp portion 502 and the band portion 506 might exist when the bracelet 500 is in its tightest configuration can be further reduced thanks to the hinge 503, which will allow the clasp portion 502 to rotate further to follow the curvature of the band portion 506. While wearing the bracelet and during the wearer's natural movements, the hinge 503 allows the clasp portion 502 flexibility to move with the wearer and maintain the integrity of the overall shape of the bracelet 500 while preventing the hook portion 504 from becoming inadvertently or unintentionally unhooked from the clasp portion 502 and preventing the free end of the clasp portion 502 from catching on something that would cause the clasp portion 502 to become unhooked or deformed.

Figures 7A, 7B, 7C:
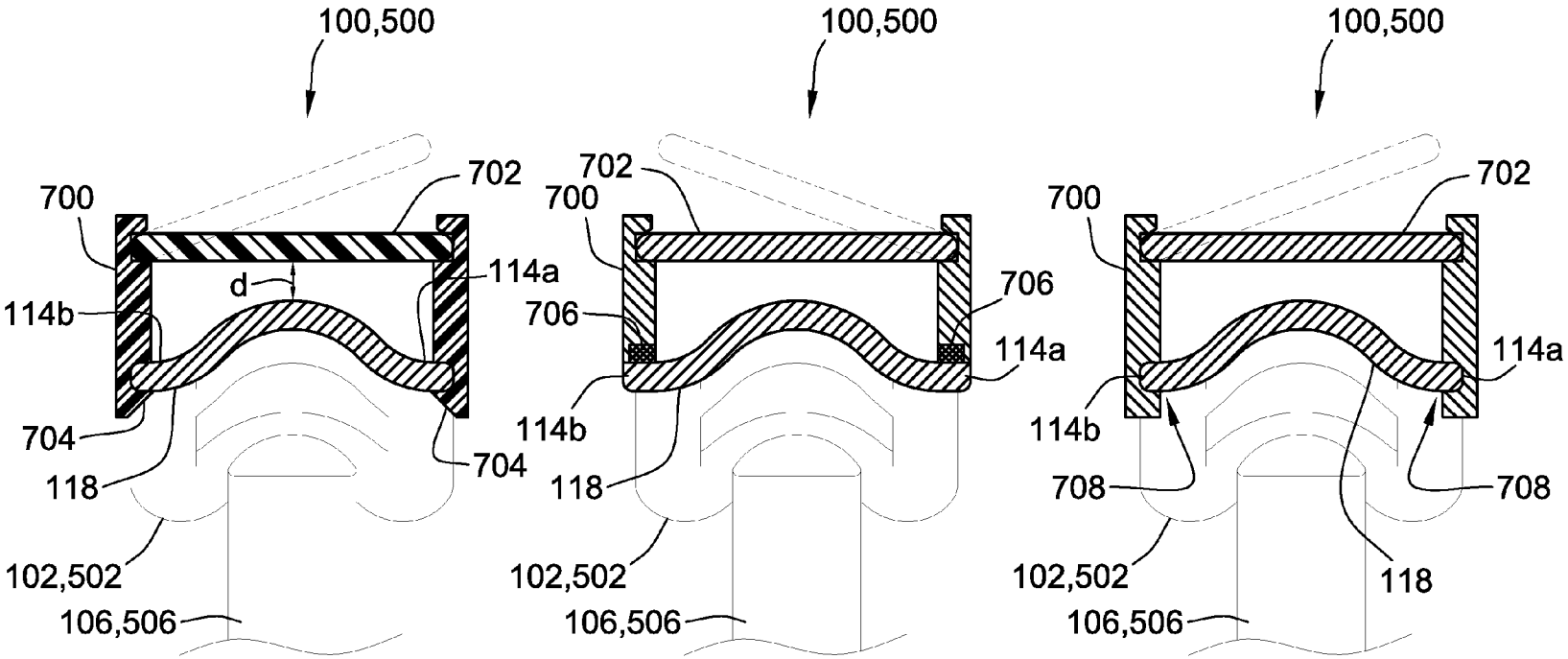
FIG. 7A is an end cross sectional view of any of the clasp portions shown herein with a cover and an insert over the clasp portion according to an embodiment in which the cover clicks or snaps to the clasp portion.
FIG. 7B is an end cross sectional view of any of the clasp portions shown herein with a cover and an insert over the clasp portion according to another embodiment in which the cover is removably secured to the clasp portion by magnets.
FIG. 7C is an end cross sectional view of any of the clasp portions shown herein with a cover and an insert over the clasp portion according to yet another embodiment in which the cover is slid over the free end of the clasp portion until it covers the clasp portion.

FIG. 7A is an end cross sectional view of any of the clasp portions 102, 502 disclosed herein with a cover 700 and an insert 702 over the clasp portion 102, 502 according to an embodiment in which the cover 700 clicks or snaps to the clasp portion 102, 502. The insert 702 can be snap clicked into recesses formed in the cover 700, and the wearer can pop the insert 702 out of the cover from either long edge of the insert 702 (compare FIG. 7A with 7B) to install a different insert into the cover 700. The cover 700 in this example can be press clicked over the support members 114*a,b* of the clasp portion 102, 502, with angled features 704 that aid in bending the vertical walls of the cover 700 outwardly to click the cover 700 into place over the support members 114*a,b*. The insert 702 is separated by a distance, d, from the uppermost part of the raised structure 118 to allow the hook portion 104 to disengage from the raised structure 118. Thus, the distance, d, must be at least slightly greater than the thickness of the hook portion 104.

FIG. 7B is an end cross sectional view of any of the clasp portions 102, 502 disclosed herein with a cover 700 and an insert 702 over the clasp portion 102, 502 according to another embodiment in which the cover 700 is removably secured to the clasp portion 102, 502 by magnets 706. For example, the clasp portion 102, 502 can be made of a magnetized material, or the magnets 706 can be attached to the support members 114*a,b* of the clasp portion 102, 502. In the former example, the cover 700 can be made of any magnetized or non-magnetized material, whereas in the latter example, the cover 700 can be made of a magnetized material.

FIG. 7C is an end cross sectional view of any of the clasp portions 102, 502 disclosed herein with a cover 700 and an insert 702 over the clasp portion 102, 502 according to yet another embodiment in which the cover 700 is slid over the free end of the clasp portion 102, 502 until it covers the clasp portion 102, 502. In this example, the cover 700 is curved to follow the curvature of the clasp portion 102, 502, so that when slid thereover, the cover 700 follows the same curvature as the clasp portion 102, 502 (see FIG. 11). The cover 700 includes recessed features 708 that receive respective support members 114*a,b* as the cover 700 is slid over the clasp portion 102, 502.

Figure 8:
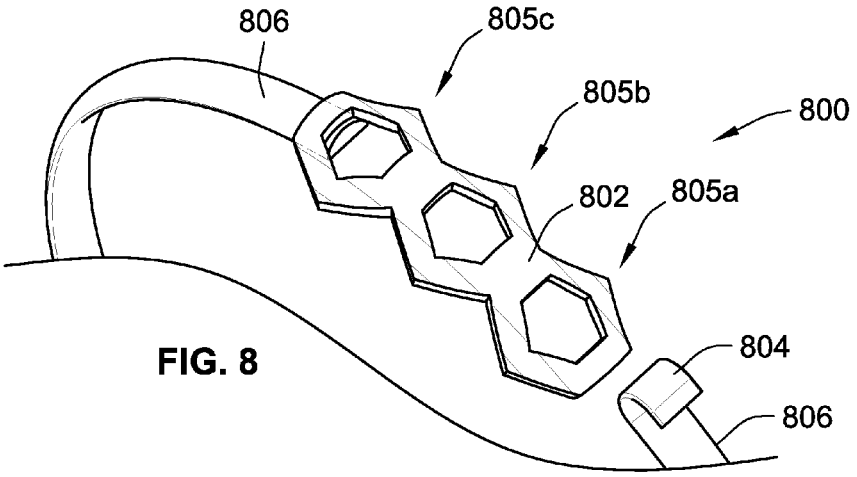
FIG. 8 is an isometric view of part of an adjustable bracelet featuring a different clasp portion design formed by approximately hexagonal-shaped structures joined together.

FIG. 8 is an isometric view of part of an adjustable bracelet 800 featuring a different clasp portion 802 design formed by approximately hexagonal-shaped structures 805*a,b,c* joined together as a monolithic integral piece of from separate pieces. In this example, there are no raised structures for the hook portion 804 to engage. However, the structures that engage the hook portion 804 have flat surfaces, which can aid in preventing twisting of the clasp portion 802 relative to the band portion 806 when the bracelet 800 is worn.

Figure 9:
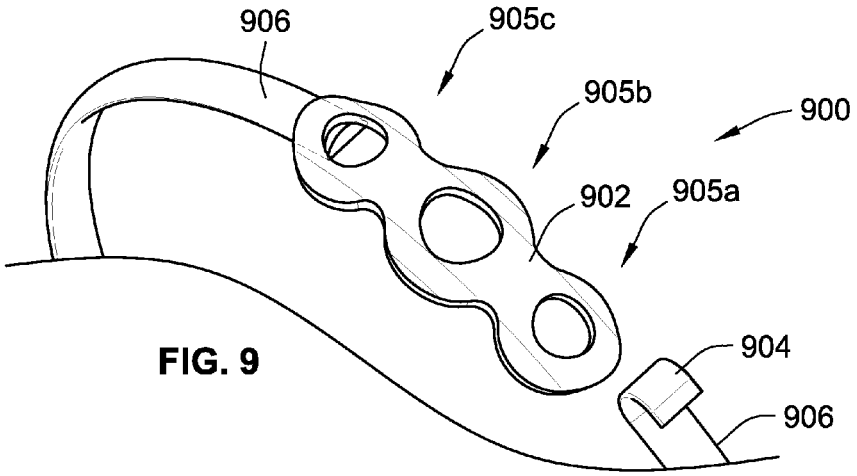
FIG. 9 is an isometric view of part of an adjustable bracelet featuring a different clasp portion design formed by approximately round or oval structures joined together.

FIG. 9 is an isometric view of part of an adjustable bracelet 900 featuring a different clasp portion 902 design formed by approximately round or oval structures 905*a,b,c* joined together as a monolithic integral piece of from separate pieces. In this example, the central structure 905*b* can be slightly larger than the other structures 905*a,c* to make it easier for the hook portion 904 to engage this central structure 905*b*. For example, if a significant majority of wearers will prefer to use the central position, this structure 905*b* can be made larger so that the hook portion 904 will "prefer" to hook onto this structure, or at least it will be easier to hook the hook portion 904 to this structure.

Figure 10:
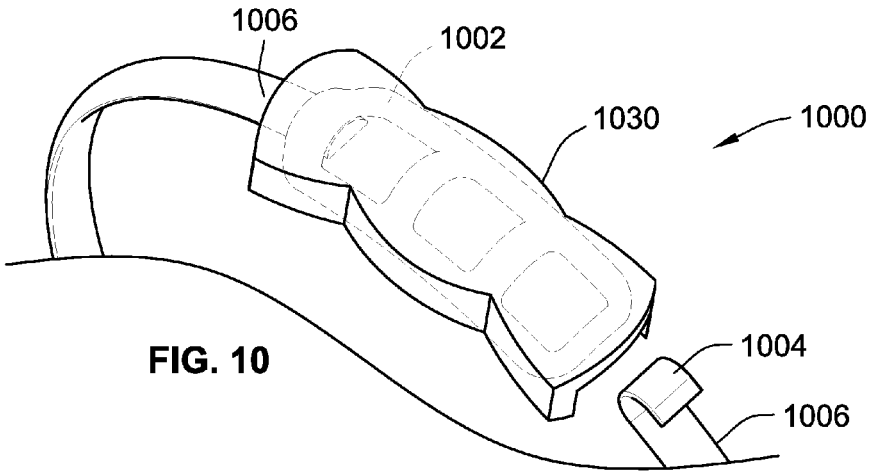
FIG. 10 is an isometric view of part of an adjustable bracelet featuring a different cover design that covers any of the clasp portions disclosed herein.

FIG. 10 is an isometric view of part of an adjustable bracelet 1000 featuring a different cover 1030 design that covers any of the clasp portions 1002 disclosed herein. The cover 1030 is shaped to fit completely over the clasp portion 1002 when the hook portion 1004 is hooked onto the clasp portion 1002. This hides the hook portion 1004, making the bracelet 1000 appear as if an uninterrupted band.

Figure 11:
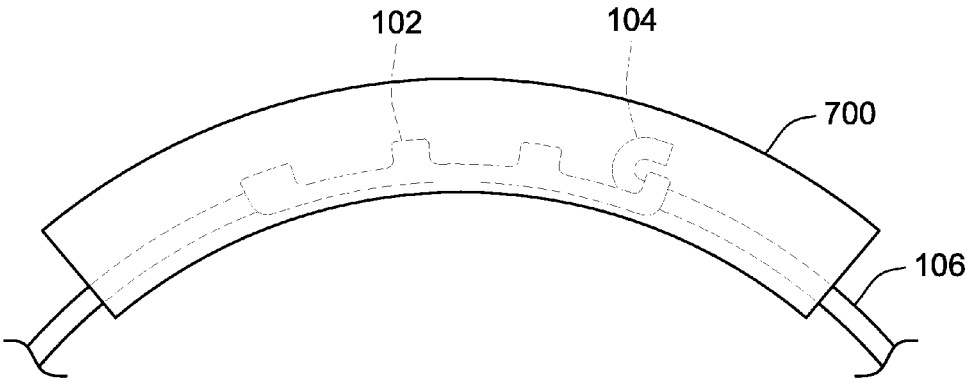
FIG. 11 is a side view of an adjustable bracelet featuring a cover over the clasp portion.

FIG. 11 is a side view of an adjustable bracelet 100 featuring a cover 700 over the clasp portion 102. This cover 700 can correspond to any of the covers shown and described in connection with FIGS. 7A-7C.

Figure 12:
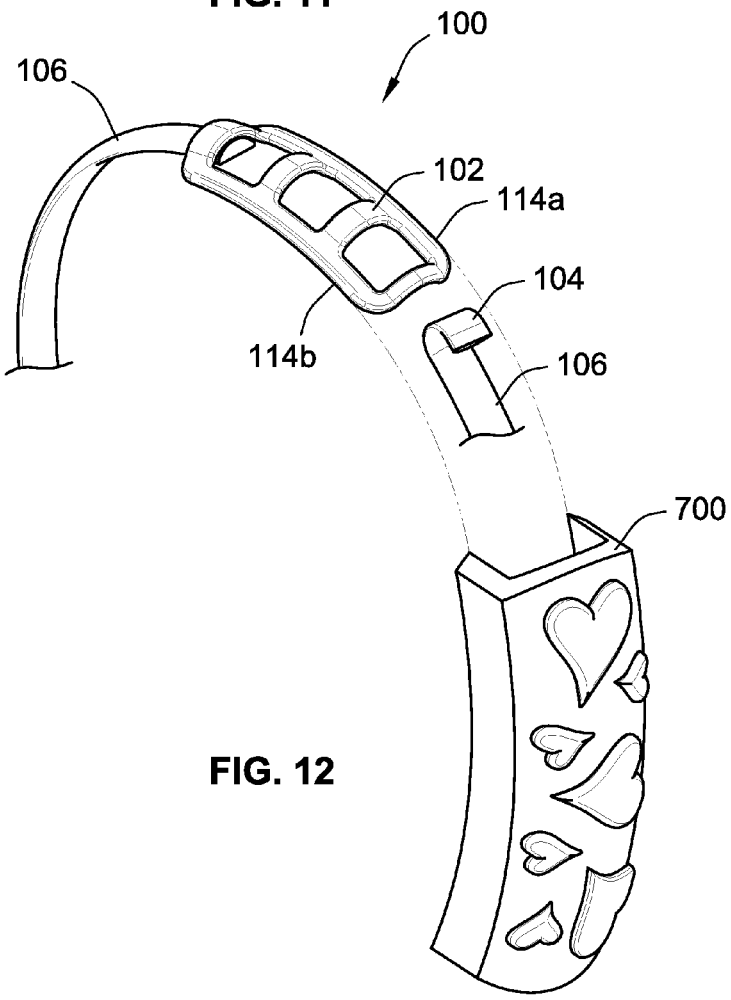
FIG. 12 is an isometric view of part of an adjustable bracelet showing a cover about to be slid over the clasp portion.

FIG. 12 is an isometric view of part of an adjustable bracelet 100 showing a cover 700 about to be slid over the support members 114*a,b* of the clasp portion 102. The cover 700 features a raised design, which when installed conceals most or all of the clasp portion 102 and the hook portion 104 of the bracelet 100.

Figure 13:
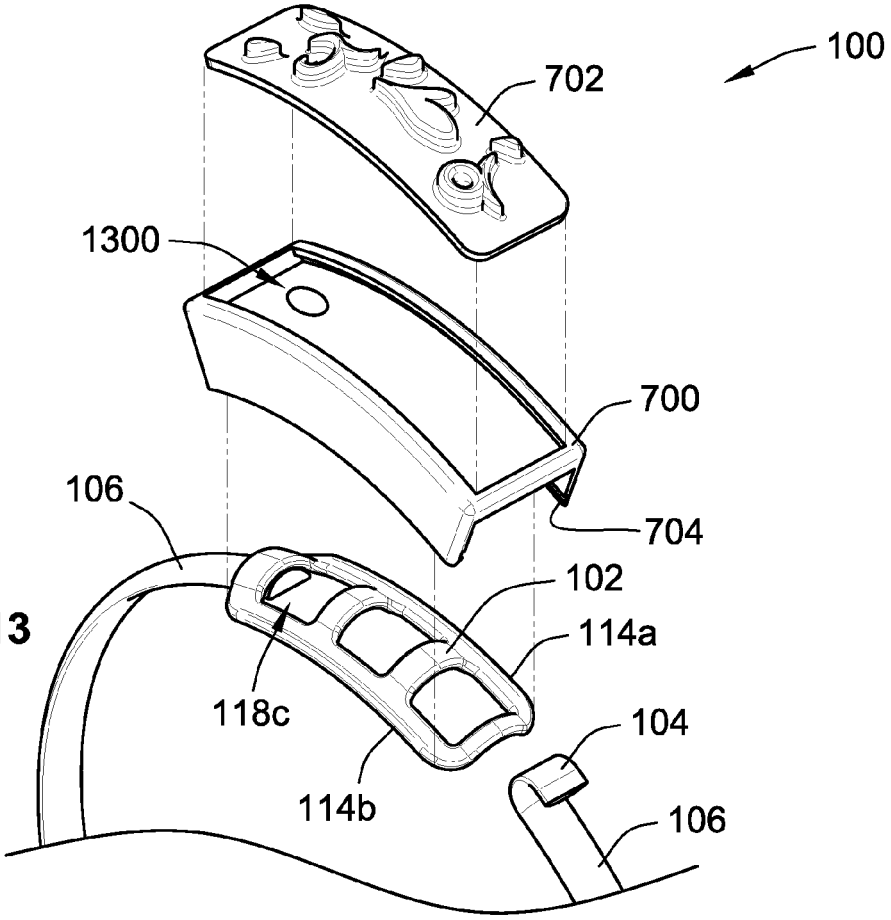
FIG. 13 is an exploded isometric view of an insert snapped into a cover, which is secured over a clasp portion.

FIG. 13 is an exploded isometric view of a removable or interchangeable insert 702 snapped into a cover 700, which is snapped onto the support members 114*a,b* of a clasp portion 102. As explained above in connection with FIGS. 7A-7C, the insert 702 can be removable to allow different inserts to be installed on the cover 700. In this example, the insert 702 features a raised design, resembling a filigree or other ornamental design. A hole 1300 can be formed in the cover 700 to allow an object, like a pen or paper clip, to be inserted through the bottom of the cover 700 to pop off the insert 702 and dislodge the insert 702 from the engagement features of the cover 700 that secure the insert 702 thereon. This hole 1300 can align with a corresponding opening 118*c* in the clasp portion 102, which allows the insert to be removed without removing the cover 700 from the clasp portion 102.

Figure 14:
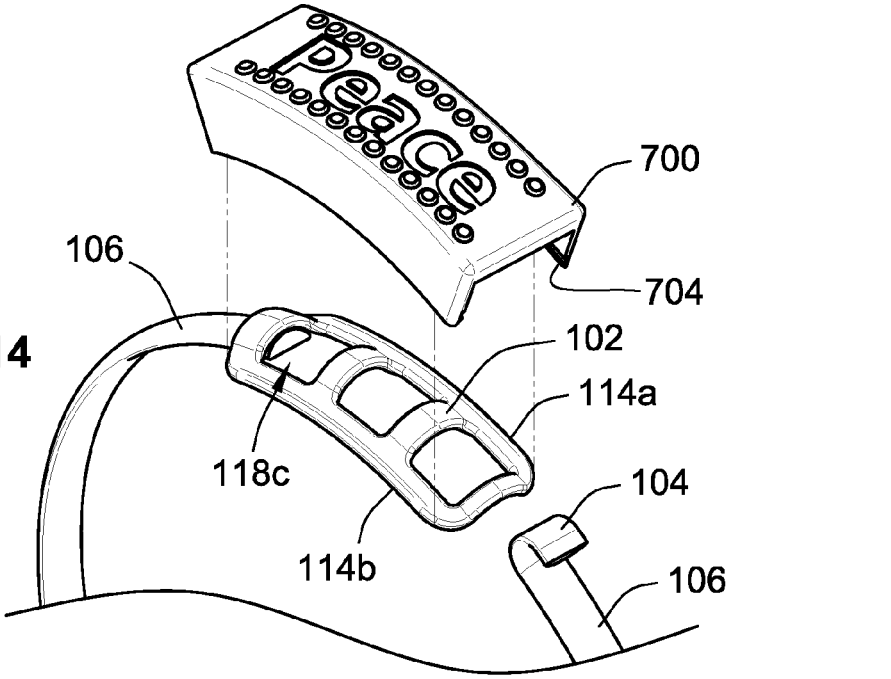
FIG. 14 is an exploded isometric view of a cover featuring a design about to be secured over a clasp portion.

FIG. 14 is an exploded isometric view of a cover 700 featuring a filigree design about to be secured over a clasp portion 102. Different covers with different ornamental designs can be snapped over the clasp portion 102, while concealing the clasp portion 102 and the hook portion 104.

Figure 15:
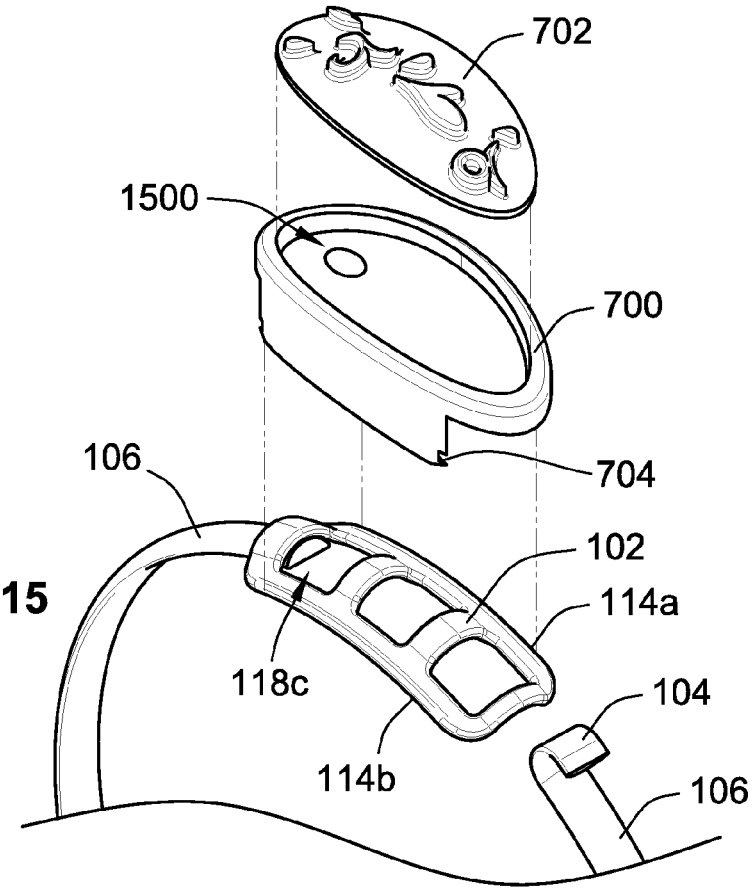
FIG. 15 is an exploded isometric view of an oval-shaped insert snapped into an oval-shaped cover, which is secured over a clasp portion.

FIG. 15 is an exploded isometric view of an oval-shaped insert 702 snapped into an oval-shaped cover 700, which is secured over a clasp portion 102. In other words, the shape of the cover 700 and insert 702 can be any shape that can be fitted over or onto the clasp portion 102. The insert 702 features a filigree or ornamental design in this example. A hole 1500 can be used to aid in removing the insert 702 by inserting a thin object like a paper clip through the hole 1500 to pop the insert 702 off of the cover 700.

Figure 16:
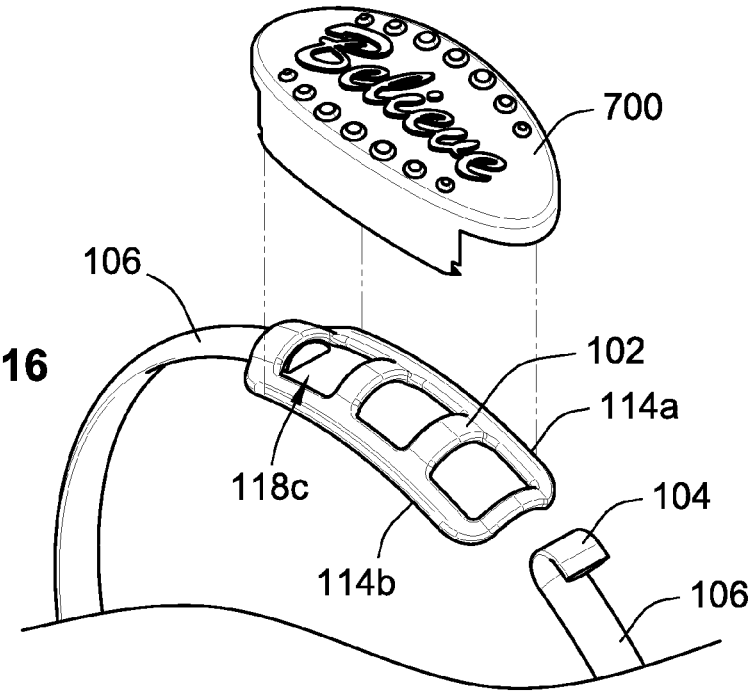
FIG. 16 is an exploded isometric view of an oval-shaped insert snapped into an oval-shaped cover, which is secured over a clasp portion.
Figure 17:
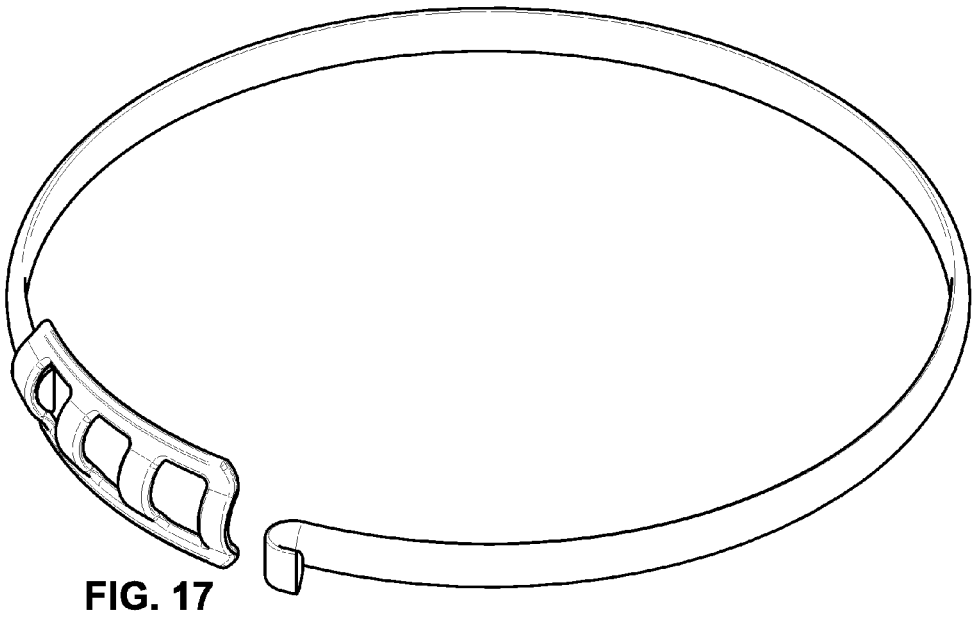
FIG. 17 is a top isometric view of an adjustable bracelet.
Figure 18:
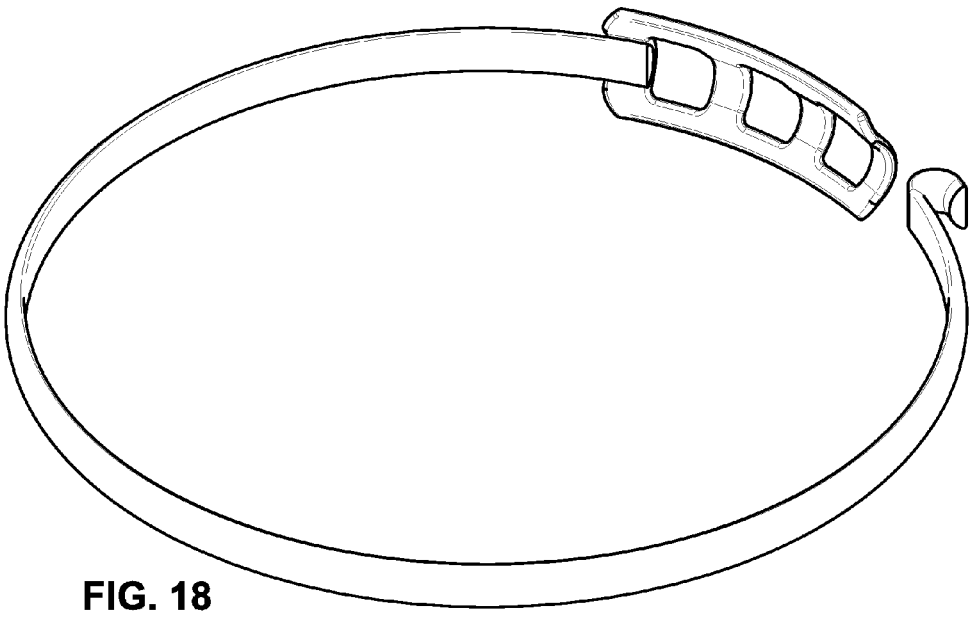
FIG. 18 is a bottom isometric view of the adjustable bracelet shown in FIG. 17.
Figure 19:
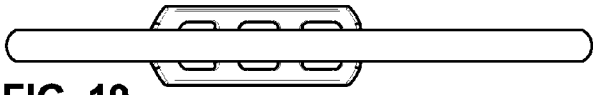
FIG. 19 is a bottom view of the adjustable bracelet shown in FIG. 17.
Figure 20:
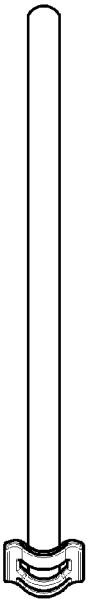
FIG. 20 is an end view of one end of the adjustable bracelet shown in FIG. 17.
Figure 21:
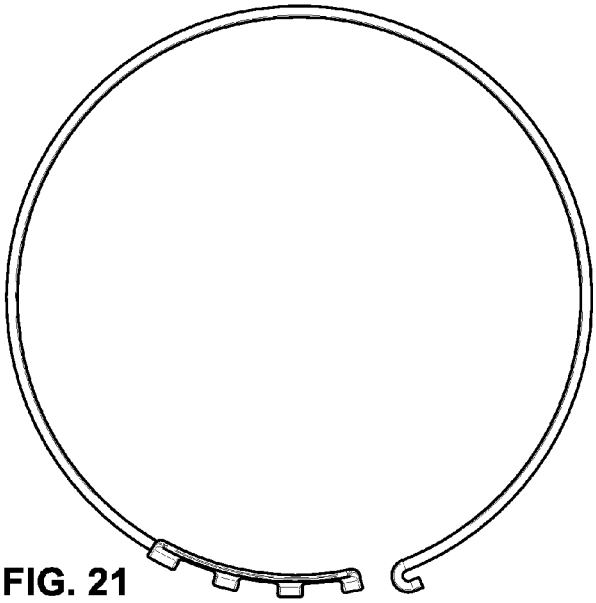
FIG. 21 is a side view of one side of the adjustable bracelet shown in FIG. 17.
Figure 22:
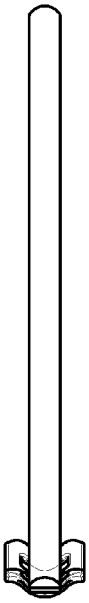
FIG. 22 is an end view of another end of the adjustable bracelet shown in FIG. 17.
Figure 23:
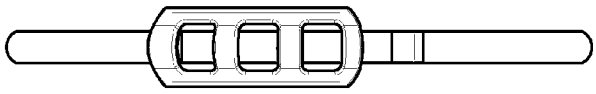
FIG. 23 is a top view of the adjustable bracelet shown in FIG. 17.
Figure 24:
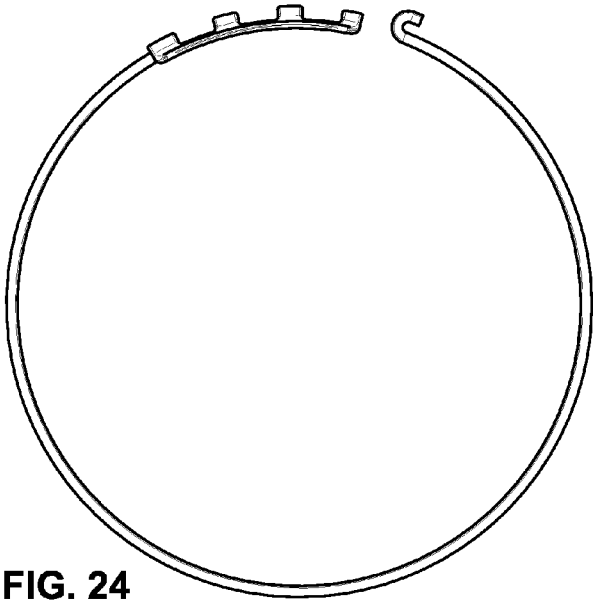
FIG. 24 is a side view of the other side of the adjustable bracelet shown in FIG. 17.
Figure 25:
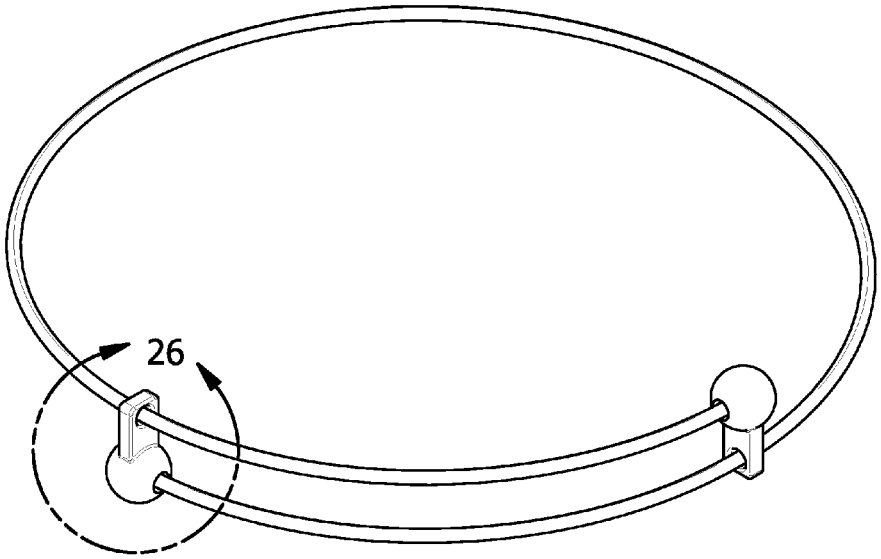
FIG. 25 is an isometric view of an adjustable bracelet.
Figure 26:
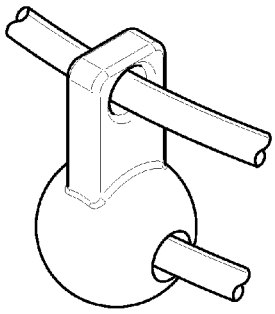
FIG. 26 is an enlarged view of the area shown in FIG. 25.
Figure 27:
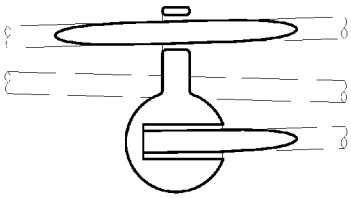
FIG. 27 is a cross sectional view of the enlarged view shown in FIG. 26.
Figure 28:
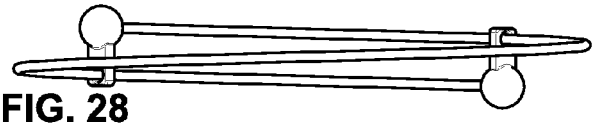
FIG. 28 is an end view of one end of the adjustable bracelet shown in FIG. 25 in a horizontal orientation.
Figure 29:
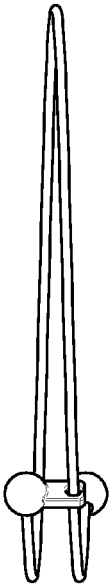
FIG. 29 is an end view of the end of the adjustable bracelet shown in FIG. 28 in a vertical orientation.
Figure 30:
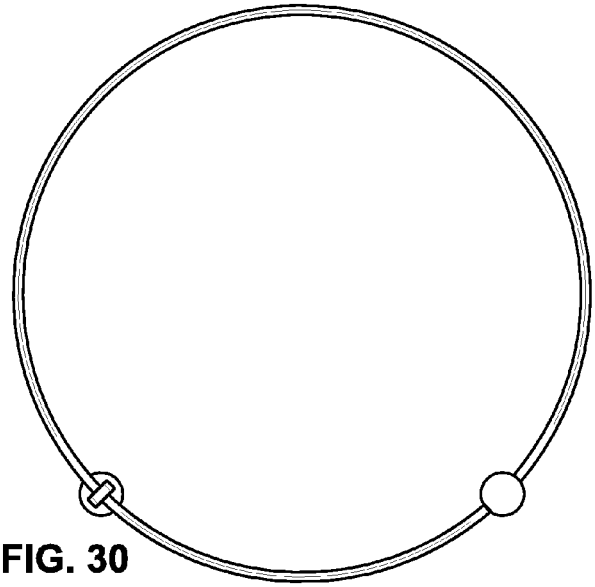
FIG. 30 is a side view of one side of the adjustable bracelet shown in FIG. 25.
Figure 31:
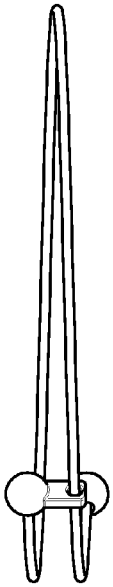
FIG. 31 is an end view of the other end of the adjustable bracelet shown in FIG. 25 in a vertical orientation.
Figure 32:
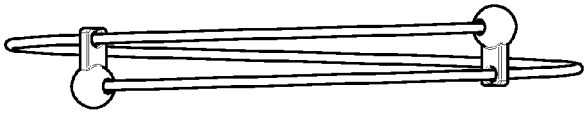
FIG. 32 is an end view of the other end of the adjustable bracelet shown in FIG. 31 in a horizontal orientation.
Figure 33:
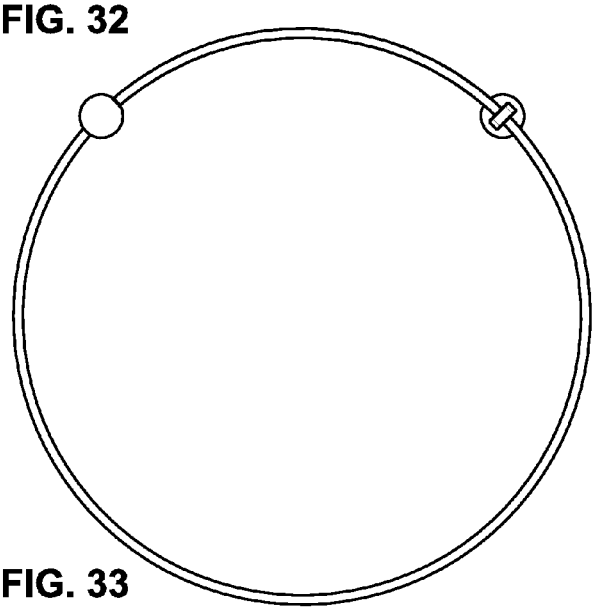
FIG. 33 is a side view of the other side of the adjustable bracelet shown in FIG. 25.
Figure 34:
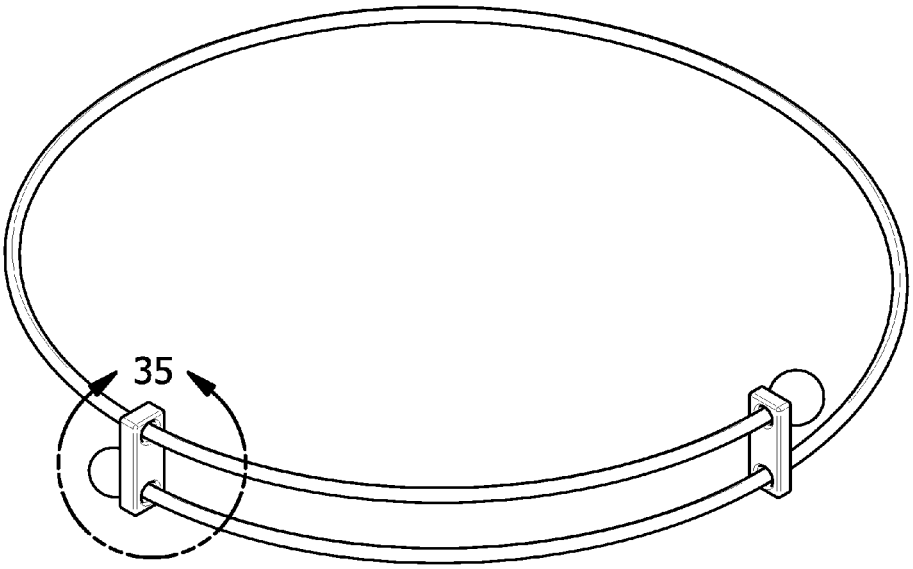
FIG. 34 is an isometric view of an adjustable bracelet.
Figure 35:
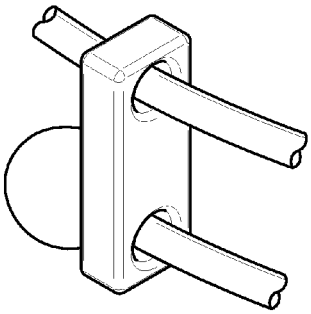
FIG. 35 is an enlarged view of the area shown in FIG. 34.
Figure 36:
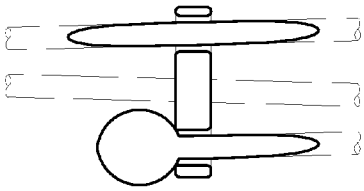
FIG. 36 is a cross sectional view of the enlarged view shown in FIG. 35.
Figure 37:
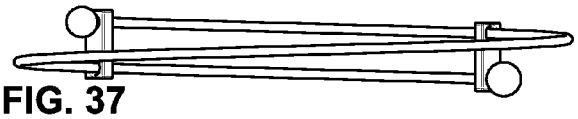
FIG. 37 is an end view of one end of the adjustable bracelet shown in FIG. 34 in a horizontal orientation.
Figure 38:
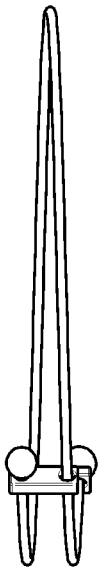
FIG. 38 is an end view of the end of the adjustable bracelet shown in FIG. 37 in a vertical orientation.
Figure 39:
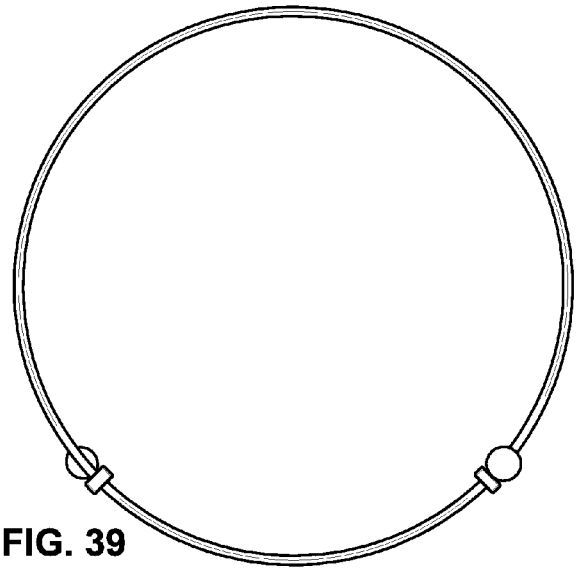
FIG. 39 is a side view of one side of the adjustable bracelet shown in FIG. 34.
Figure 40:
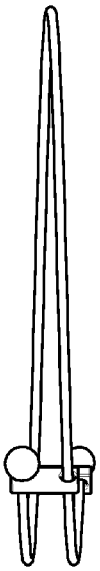
FIG. 40 is an end view of the other end of the adjustable bracelet shown in FIG. 34 in a vertical orientation.
Figure 41:
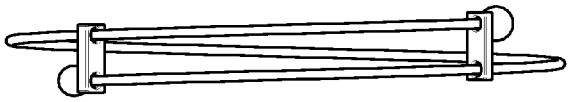
FIG. 41 is an end view of the other end of the adjustable bracelet shown in FIG. 40 in a horizontal orientation.
Figure 42:
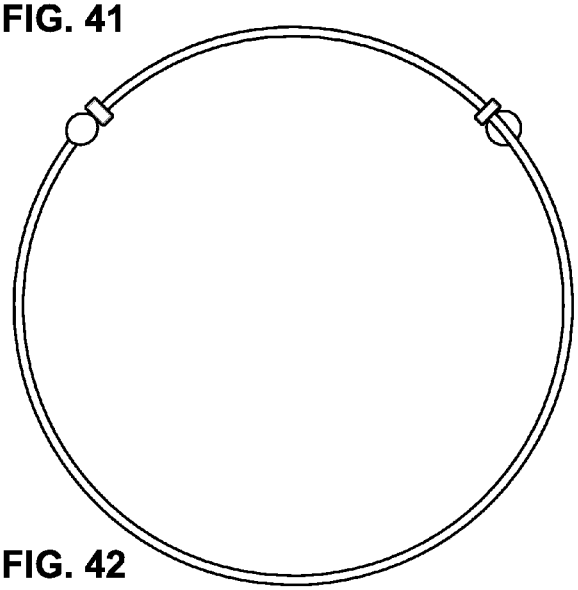
FIG. 42 is a side view of the other side of the adjustable bracelet shown in FIG. 34.
Figure 43:
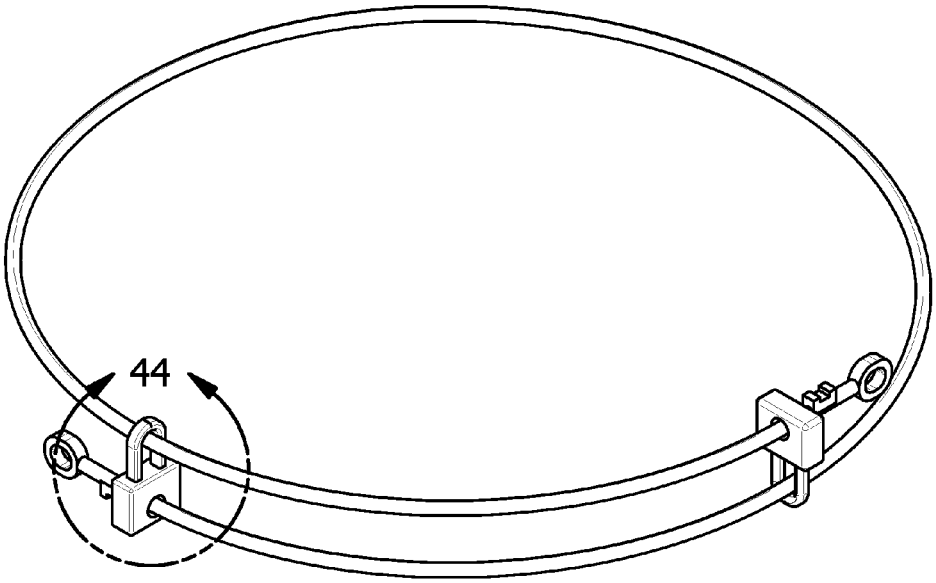
FIG. 43 is an isometric view of an adjustable bracelet.
Figure 44:
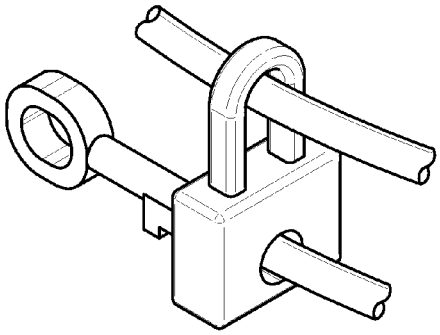
FIG. 44 is an enlarged view of the area shown in FIG. 43.
Figure 45:
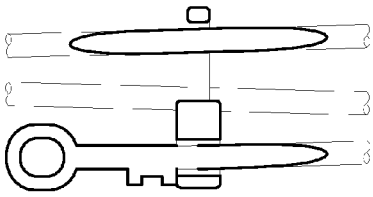
FIG. 45 is a cross sectional view of the enlarged view shown in FIG. 44.
Figure 46:
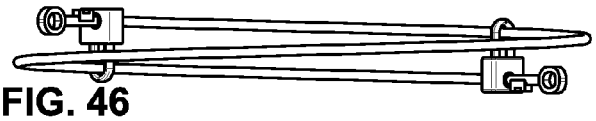
FIG. 46 is an end view of one end of the adjustable bracelet shown in FIG. 43 in a horizontal orientation.
Figure 47:
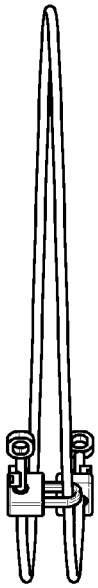
FIG. 47 is an end view of the end of the adjustable bracelet shown in FIG. 46 in a vertical orientation.
Figure 48:
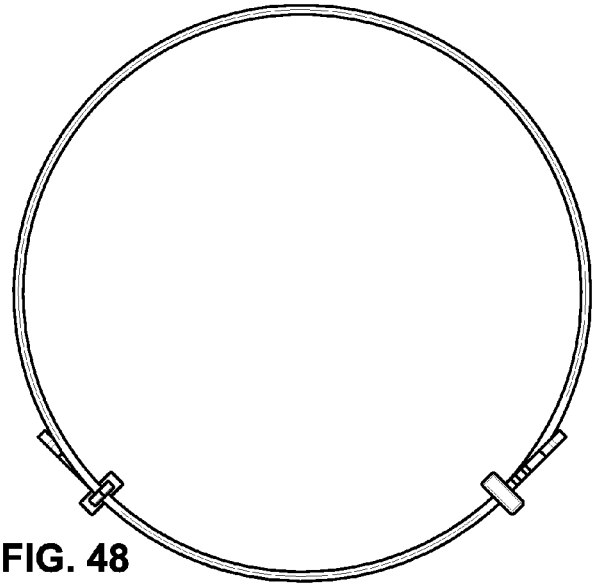
FIG. 48 is a side view of one side of the adjustable bracelet shown in FIG. 43.
Figure 49:
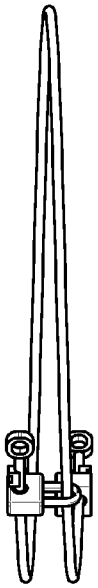
FIG. 49 is an end view of the other end of the adjustable bracelet shown in FIG. 43 in a vertical orientation.
Figure 50:
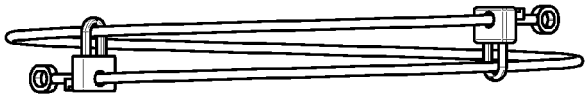
FIG. 50 is an end view of the other end of the adjustable bracelet shown in FIG. 49 in a horizontal orientation.
Figure 51:
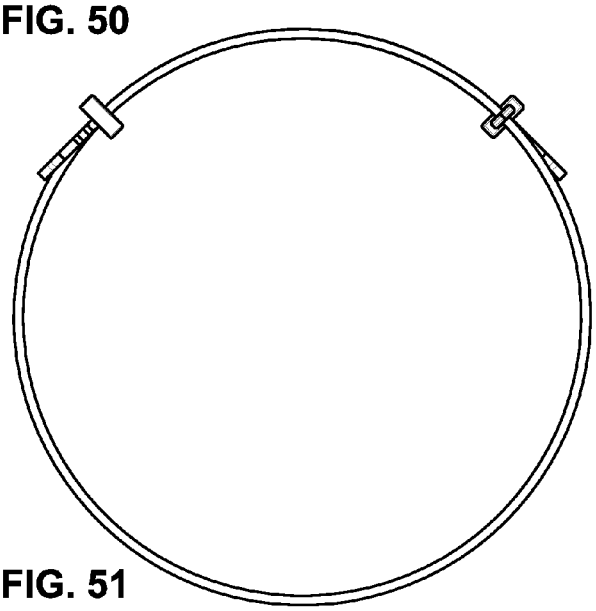
FIG. 51 is a side view of the other side of the adjustable bracelet shown in FIG. 43.
Figure 52:
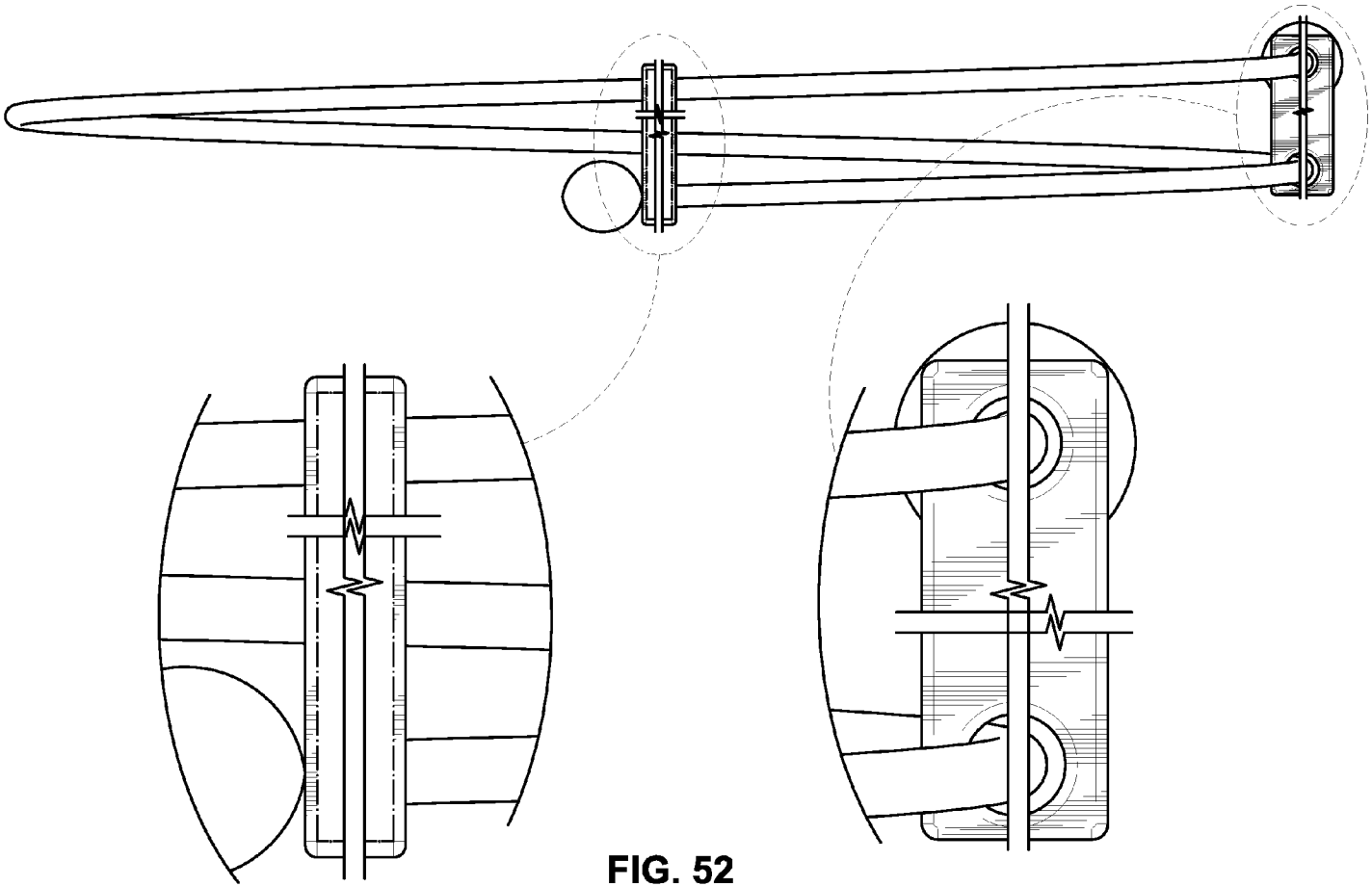
FIG. 52 is an end view of the adjustable bracelet shown in FIG. 34 with two enlarged callouts to show details of the clasp.
Figure 53:
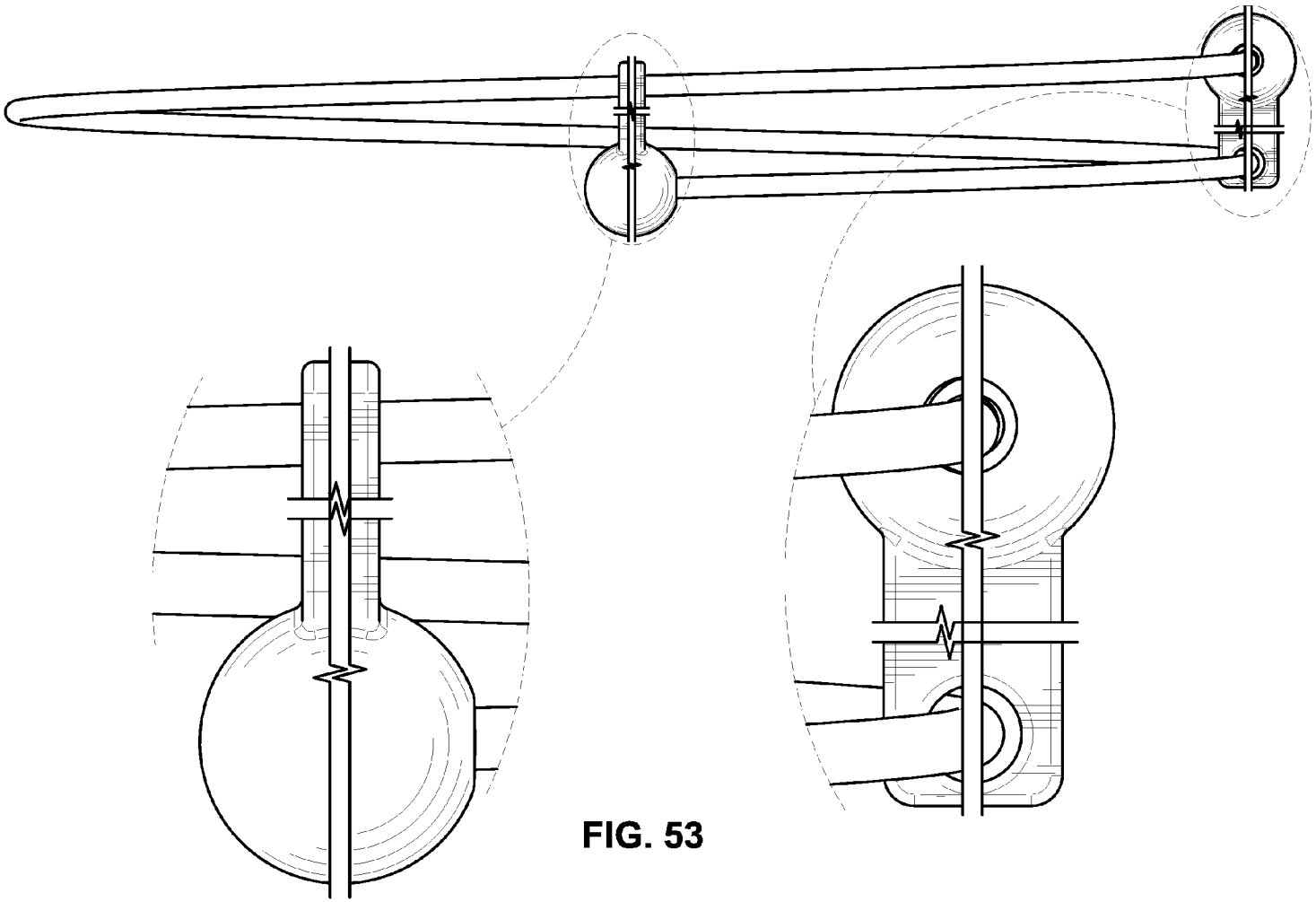
FIG. 53 is an end view of the adjustable bracelet shown in FIG. 25 with two enlarged callouts to show details of the clasp.
Figure 55:
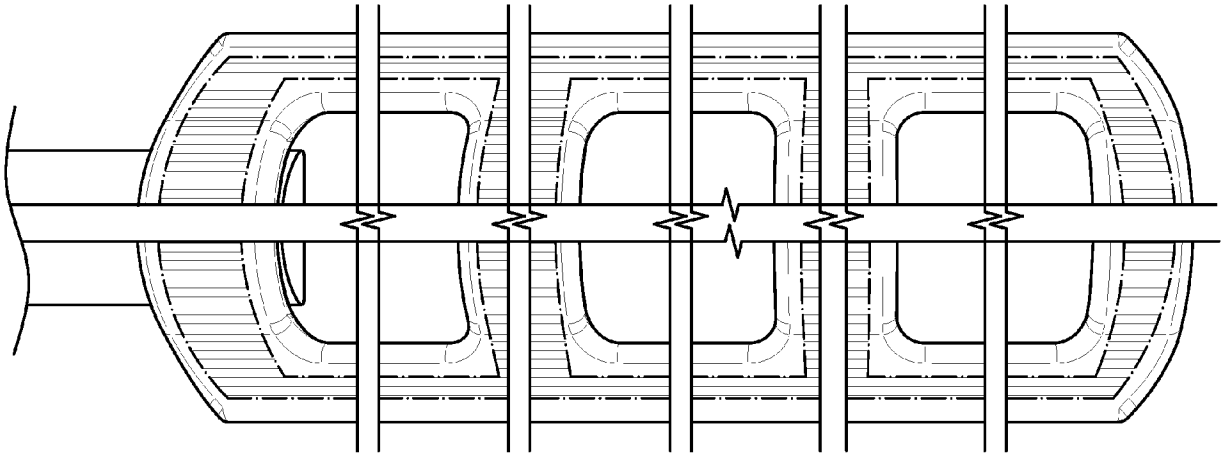
FIG. 55 is a top view of the adjustable clasp shown in FIG. 17.

FIG. 16 is an exploded isometric view of an oval-shaped cover 700 featuring a filigree or ornamental design on a top surface thereof, which cover 700 is snapped or clicked or press-fitted onto a clasp portion 102.

FIGS. 17-56 illustrate various aspects of the present disclosure, and their descriptions can be found in the above Brief Description of the Drawings. The broken lines shown in FIGS. 17-44 are only for illustrative purposes to show visible environmental structure and form no part of any ornamental design claimed herein.

What is claimed is:

1. A bracelet having an adjustable clasp portion, comprising:

a clasp portion defining a first end;

a hook portion having a hook defining a second end;

a band portion between the clasp portion and the hook portion;

the clasp portion having a plurality of raised structures separated by openings, the clasp portion being curved to follow a curvature of the band portion, and each of the raised structures extending laterally relative to the band portion and protruding beyond an outer surface of the band portion to be engaged by the hook, and a cover having a curved profile that follows the curvature of the clasp portion, the cover being configured to cover the clasp portion, the cover having a gap between the clasp portion sufficient to allow the hook portion to be disengaged from any of the raised structures.

2. The bracelet of claim 1, the clasp portion further including a pair of parallel support members, each of the raised structures spanning the parallel support members to define the respective openings.

3. The bracelet of claim 2, wherein each of the openings are dimensioned to allow the hook portion to pass through each of the openings.

4. The bracelet of claim 3, wherein each of the raised structures is curved to form an inner concave surface and an outer convex surface.

5. The bracelet of claim 1, wherein the clasp portion overlaps part of the band portion as the hook portion engages a distal one of the raised structures such that the overlap between the clasp portion and the band portion results in a smaller gap compared to the clasp portion being straight.

6. The bracelet of claim 1, wherein the cover includes angled features that snap over the clasp portion to secure the cover to the clasp portion.

7. The bracelet of claim 1, further comprising magnets positioned to magnetically fix the cover and the clasp portion together.

8. The bracelet of claim 1, wherein the cover includes recessed features to permit the cover to be slid over the clasp portion to thereby secure the cover to the clasp portion when the hook portion is unhooked from the clasp portion.

9. The bracelet of claim 1, further comprising a removable insert that forms a top surface portion of the cover.

10. The bracelet of claim 9, wherein the removable insert is snapped, clicked, press-fit, or snap-fit into recessed features formed in the cover.

11. The bracelet of claim 9, wherein the cover includes a hole to permit an object passed through the hole to disengage the insert from the cover.

12. The bracelet of claim 9, wherein the removable insert is curved to follow a curvature of the cover.

13. The bracelet of claim 12, wherein the curvature of the removable insert parallels the curvature of the clasp portion when the removable insert is inserted into the cover and the cover is installed over the clasp portion.

14. The bracelet of claim 9, wherein the removable insert is composed of a metal.

15. The bracelet of claim 9, wherein the removable insert includes on a top surface thereof any one or more of a filigree, alphanumeric characters, a raised design, or a carving.

16. The bracelet of claim 1, wherein the cover is composed of a metal.

17. The bracelet of claim 1, wherein the cover includes on a top surface thereof any one or more of a filigree, alphanumeric characters, a raised design, or a carving.

18. The bracelet of claim 1, wherein the cover is configured to completely cover the clasp portion so that the clasp portion together with the hook portion are not visible from a top of the cover when the cover is secured onto the clasp portion.

* * * * *